US010352337B2

(12) United States Patent
Monden

(10) Patent No.: US 10,352,337 B2
(45) Date of Patent: Jul. 16, 2019

(54) FLUID PRESSURE CYLINDER

(71) Applicant: SMC CORPORATION, Chiyoda-ku (JP)

(72) Inventor: Kengo Monden, Ushiku (JP)

(73) Assignee: SMC CORPORATION, Chiyoda-ku (JP)

( * ) Notice: Subject to any disclaimer, the term of this patent is extended or adjusted under 35 U.S.C. 154(b) by 103 days.

(21) Appl. No.: 15/301,911

(22) PCT Filed: Jun. 25, 2014

(86) PCT No.: PCT/JP2014/066796
§ 371 (c)(1),
(2) Date: Oct. 4, 2016

(87) PCT Pub. No.: WO2015/159443
PCT Pub. Date: Oct. 22, 2015

(65) Prior Publication Data

US 2017/0152873 A1 Jun. 1, 2017

(30) Foreign Application Priority Data

Apr. 14, 2014 (JP) ..... 2014-082618

(51) Int. Cl.
*F15B 15/22* (2006.01)
*F15B 15/14* (2006.01)

(52) U.S. Cl.
CPC ..... *F15B 15/222* (2013.01); *F15B 15/149* (2013.01); *F15B 15/226* (2013.01)

(58) Field of Classification Search
CPC ..... F15B 15/22; F15B 15/222; F15B 15/223; F15B 15/226
See application file for complete search history.

(56) References Cited

U.S. PATENT DOCUMENTS 2,751,886 A * 6/1956 Doutt ..... F01B 17/00 91/26
3,267,815 A * 8/1966 Ortman ..... F15B 15/222 91/26

(Continued)

FOREIGN PATENT DOCUMENTS

CN 101598156 A 12/2009
EP 0 004 948 A1 10/1979

(Continued)

OTHER PUBLICATIONS

International Search Report dated Sep. 2, 2014, in PCT/JP2014/066796 filed Jun. 25, 2014.

(Continued)

*Primary Examiner* — Michael Leslie
*Assistant Examiner* — Michael Quandt
(74) *Attorney, Agent, or Firm* — Oblon, McClelland, Maier & Neustadt, L.L.P.

(57) ABSTRACT

A fluid pressure cylinder which has a head cover and a rod cover provided on both ends of a cylinder tube, wherein the head cover and the rod cover are formed by casting such as die-casting. A first connecting channel which recesses in a groove shape in the outward radial direction is formed in the outer-circumferential surface of a first concave section of the head cover. A ring-shaped first holder is pressed into the first concave section, causing the formation of a cross-sectionally rectangular first connecting channel, the opening region of which is sealed. In addition, the first connecting channel connects a cylinder chamber of the cylinder tube and a first cushion chamber of the head cover.

4 Claims, 8 Drawing Sheets

(56) References Cited

U.S. PATENT DOCUMENTS

| | | | | | |
|---|---|---|---|---|---|
| 4,088,061 | A * | 5/1978 | Stoll | F15B 15/223 | 277/552 |
| 4,296,675 | A * | 10/1981 | Gies | F15B 15/222 | 277/580 |
| 4,794,681 | A * | 1/1989 | Boyer | F15B 15/223 | 29/888.44 |
| 7,021,192 | B2 * | 4/2006 | Kita | F15B 15/223 | 251/219 |
| 2008/0173169 | A1 | 7/2008 | Ikari | | |

FOREIGN PATENT DOCUMENTS

| | | | |
|---|---|---|---|
| JP | 48-13692 | A | 2/1973 |
| JP | 2002-266813 | A | 9/2002 |
| JP | 2008-133920 | A | 6/2008 |
| JP | 2010-266054 | | 11/2010 |

OTHER PUBLICATIONS

Combined Office Action and Search Report dated Feb. 11, 2018 in Chinese Patent Application No. 201480077984.1 (with English language translation), 14 pages.

* cited by examiner

10

FLUID PRESSURE CYLINDER

TECHNICAL FIELD

The present invention relates to a fluid pressure cylinder that displaces a piston in an axial direction under the supply of a pressure fluid, and more specifically, relates to a fluid pressure cylinder having a cushion mechanism that is capable of buffering shocks at a displacement terminal end position of the piston.

BACKGROUND ART

Conventionally, as a transport means for a workpiece or the like, for example, a fluid pressure cylinder having a piston that is displaced under the supply of a pressure fluid has been used. The present applicant, as disclosed in Japanese Laid-Open Patent Publication No. 2008-133920, has proposed a fluid pressure cylinder equipped with a cushion mechanism that is capable of buffering shocks at a displacement terminal end position of the piston.

Concerning the fluid pressure cylinder having such a cushion mechanism, hollow cylindrical cushion rings are provided respectively on both end surfaces of the piston, such that when the piston is displaced along the cylinder tube, by the cushion rings being inserted with respect to a recess of a head cover or a recess of a rod cover, the flow rate of the fluid that is discharged from ports to the exterior is throttled, and the displacement speed of the piston is decelerated.

SUMMARY OF INVENTION

Recently, it has been desired to further reduce manufacturing costs of the aforementioned fluid pressure cylinder.

A general object of the present invention is to provide a fluid pressure cylinder, which is capable of reducing manufacturing costs while at the same time shortening the manufacturing process.

The present invention is characterized by a fluid pressure cylinder comprising a cylinder tube including a cylinder chamber that is closed by a pair of cover members, a piston configured to be inserted into the cylinder tube and to be displaced along an axial direction in the cylinder chamber, ports formed in the cover members and through which a pressure fluid is supplied and discharged, and a rod mounted on an end portion along the axial direction of the piston and disposed displaceably together with the piston.

In the fluid pressure cylinder, the cover members are formed by casting, each including an accommodating hole in which the rod that is displaced together with the piston is accommodated, and a groove which is recessed with respect to an inner side wall is formed in the accommodating hole, together with a ring-shaped holder into which the rod is inserted being installed in the accommodating hole, whereby the groove is closed along a direction of extension thereof, thereby constituting a passage providing communication between the cylinder chamber and the port.

According to the present invention, in the fluid pressure cylinder including the piston that is displaceable along the cylinder tube and in which the rod is provided on an end portion along the axial direction of the piston, the cover members, which are disposed on the ends of the cylinder tube, are formed by casting, each including an accommodating hole in which the rod that is displaced together with the piston is accommodated, and a groove which is recessed with respect to an inner side wall is formed in the accommodating hole, together with a ring-shaped holder into which the rod is inserted being installed in the accommodating hole, thereby closing the groove along the direction of extension thereof, and constituting a passage providing communication between the cylinder chamber and the port.

Consequently, the groove is formed simultaneously when manufacturing the cover member by casting, and it is possible to create the passage therein by closing the opening along the direction of extension of the groove by installation of the holder in the accommodating hole. Thus, compared to a case of forming the passages by processing or the like after the cover member has been manufactured, the passage can easily be formed, and along therewith, it is possible to shorten the manufacturing process, as well as to reduce manufacturing costs.

The above objects, features, and advantages of the present invention will easily be understood from the following description of a preferred embodiment when taken in conjunction with the accompanying drawings.

DESCRIPTION OF EMBODIMENTS

Figure 1:
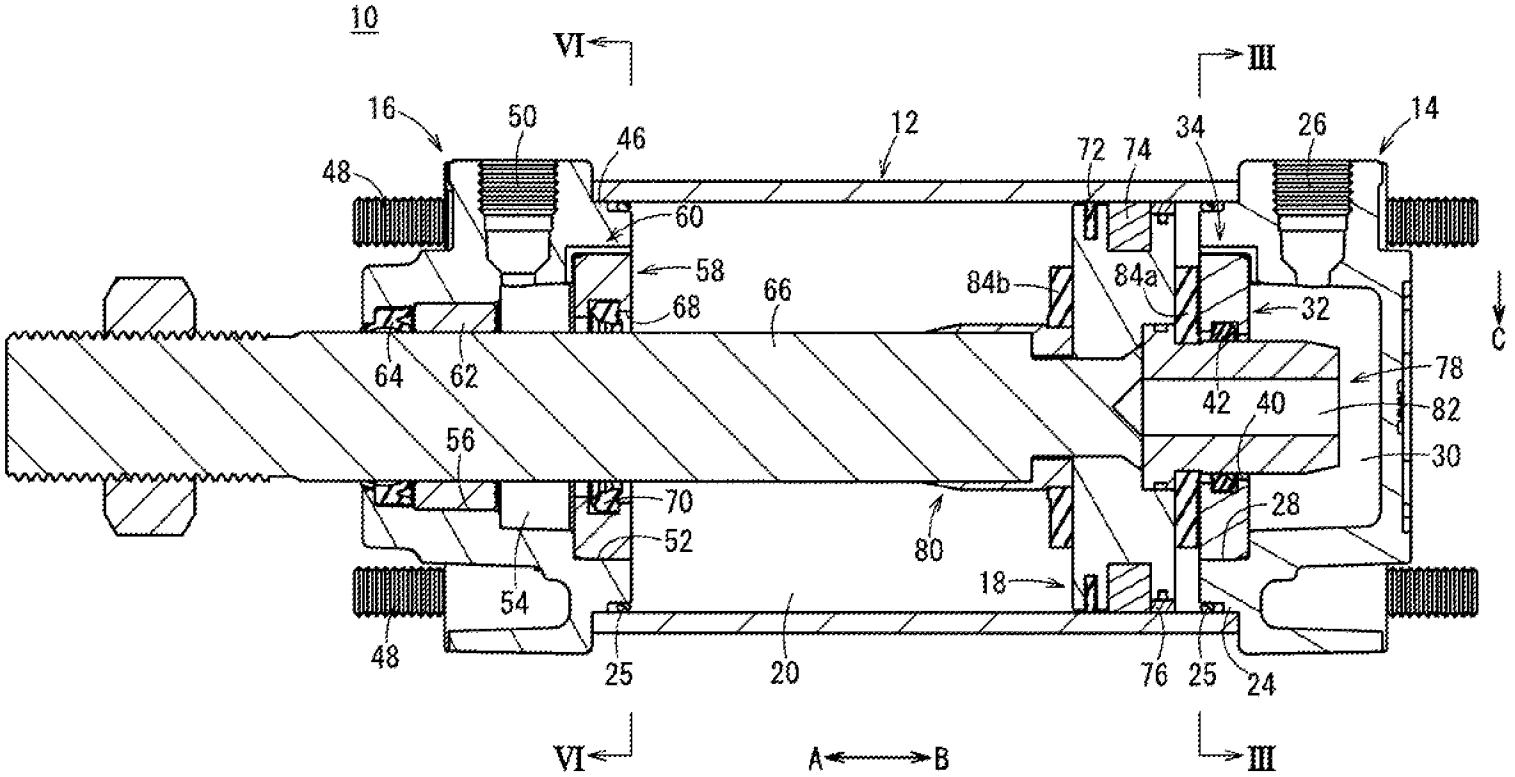
FIG. 1 is an overall cross-sectional view of a fluid pressure cylinder according to an embodiment of the present invention.

As shown in FIGS. 1 through 8, a fluid pressure cylinder 10 includes a cylindrical shaped cylinder tube 12, a head cover (cover member) 14 that is mounted on one end of the cylinder tube 12, a rod cover (cover member) 16 that is mounted on another end of the cylinder tube 12, and a piston 18 that is disposed for displacement in the interior of the cylinder tube 12.

The cylinder tube 12, for example, is constituted from a cylindrical body that extends with a substantially constant diameter along an axial direction (the directions of arrows A and B), and in the interior thereof, a cylinder chamber 20 is formed in which the piston 18 is accommodated, and which is closed by the head cover 14 and the rod cover 16.

Figure 2:
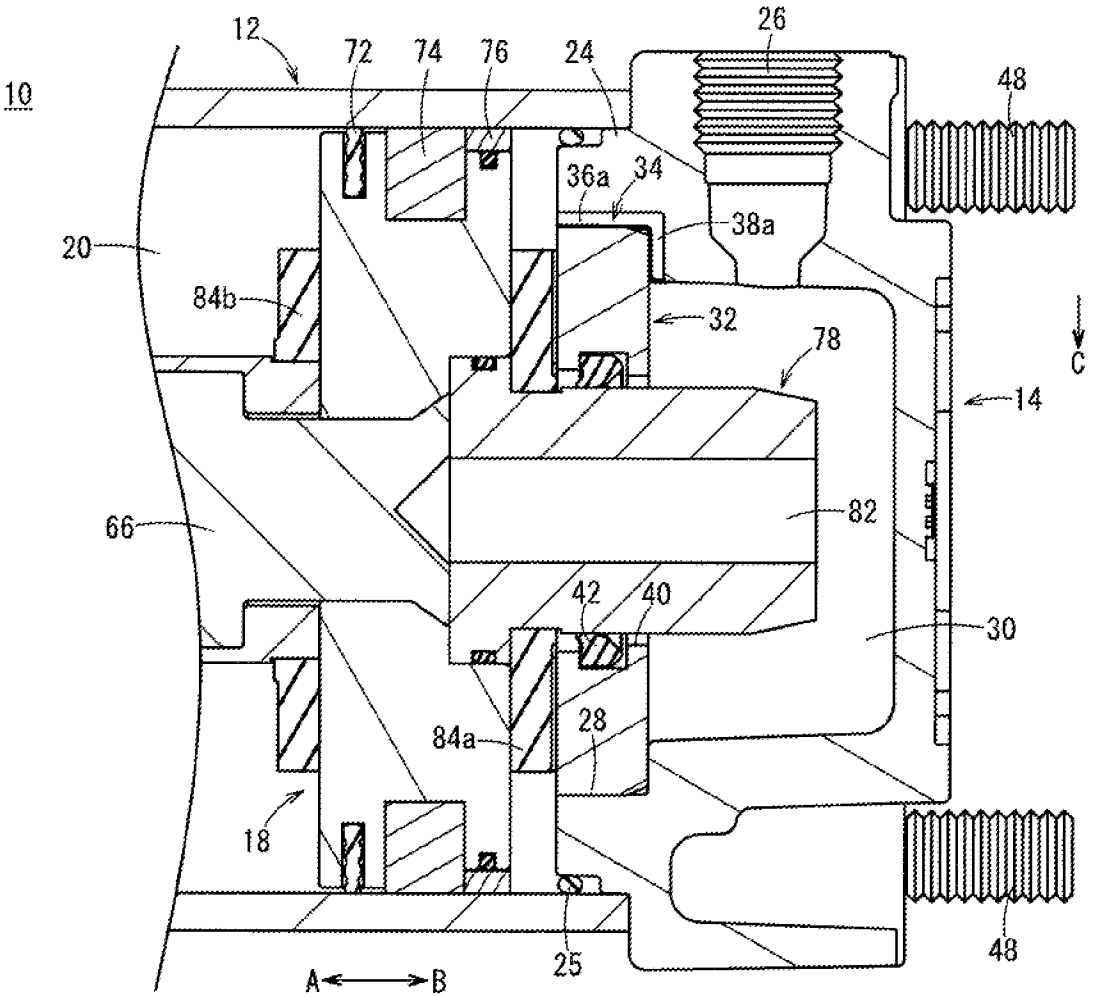
FIG. 2 is an enlarged cross-sectional view showing the vicinity of a head cover in the fluid pressure cylinder of FIG. 1.
Figure 3:
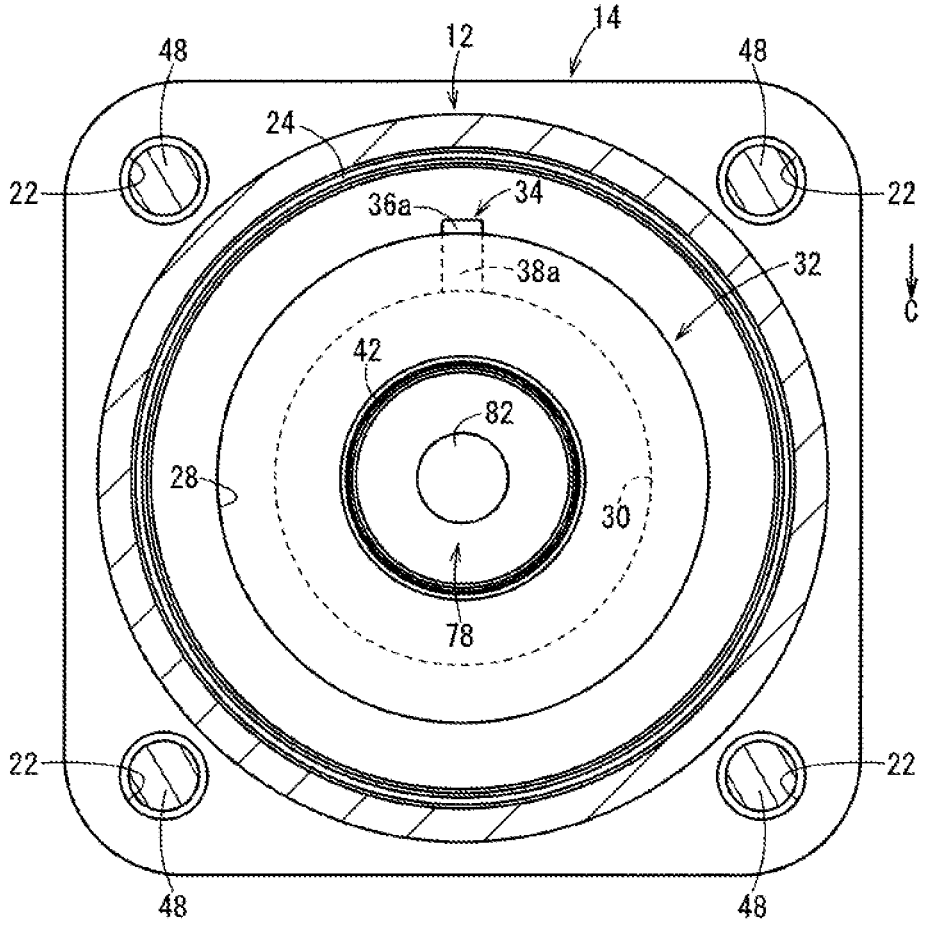
FIG. 3 is a cross-sectional view taken along line III-III of FIG. 1.

The head cover 14 is formed, for example, by a casting technique such as die casting or the like from a metallic material such as an aluminum alloy or the like, and as shown in FIG. 3, is formed with a rectangular shape in cross section having first through holes 22 that penetrate in the axial direction (the directions of arrows A and B) being formed in the four corners thereof. Further, as shown in FIGS. 1 and 2, a first stepped portion 24, which projects at a predetermined length from an end that faces toward the side of the rod cover 16 (in the direction of the arrow A), is formed on the head cover 14, and one end of the cylinder tube 12 is retained by being inserted over an outer circumferential side of the first stepped portion 24. On the outer circumferential side of the first stepped portion 24, a gasket 25 is disposed between the first stepped portion 24 and the cylinder tube 12, whereby leakage of the pressure fluid is prevented.

On the outer side of the head cover 14, a first port 26 is formed that extends in a perpendicular direction to the axial line of the head cover 14, and in the first port 26, pressure fluid is supplied and discharged through non-illustrated piping.

On the other hand, in a central portion of the head cover 14, a first recess (accommodating hole) 28 is formed at a predetermined depth with a circular shape in cross section in facing relation to the side of the cylinder tube 12 (in the direction of the arrow A), and together therewith, a first cushion chamber 30 is formed that communicates with the first recess 28. The first cushion chamber 30 is formed at a position on the inner circumferential side of the first stepped portion 24.

A ring-shaped first holder 32 is press-fitted and fixed in the first recess 28, and a first communication passage (passage) 34, which is recessed in a radial outer direction, is formed with respect to the inner circumferential surface thereof.

Figure 4:
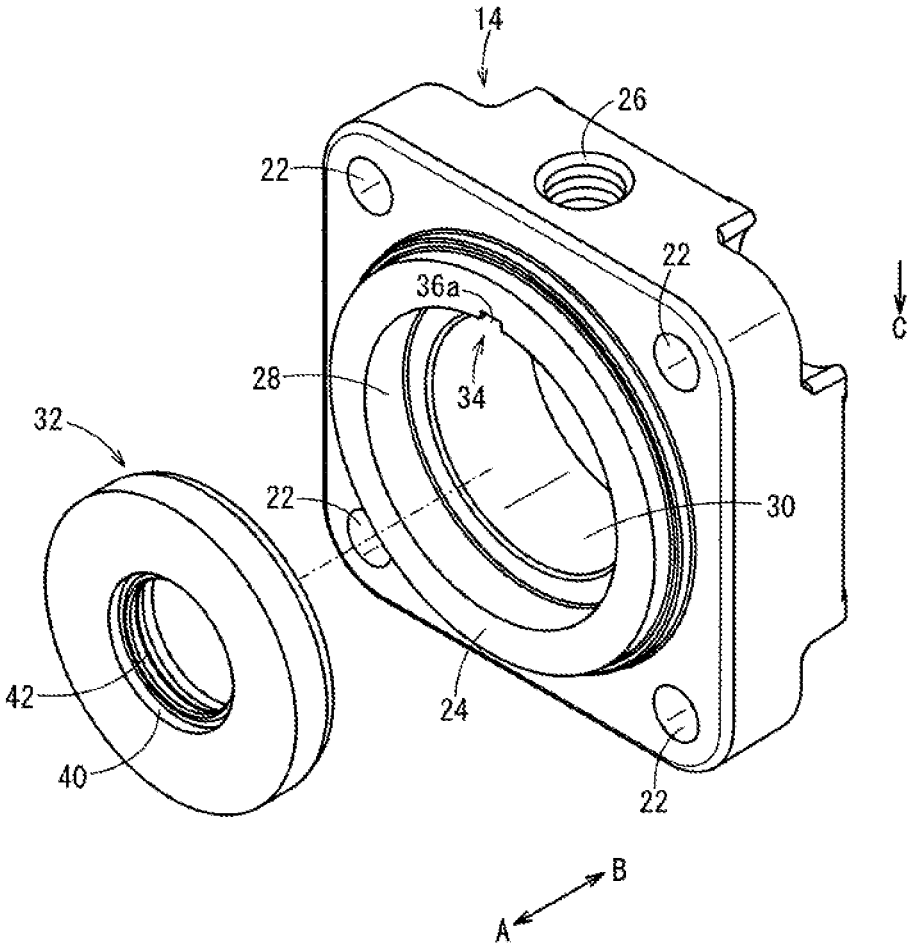
FIG. 4 is an exploded perspective view of the head cover.
Figure 5:
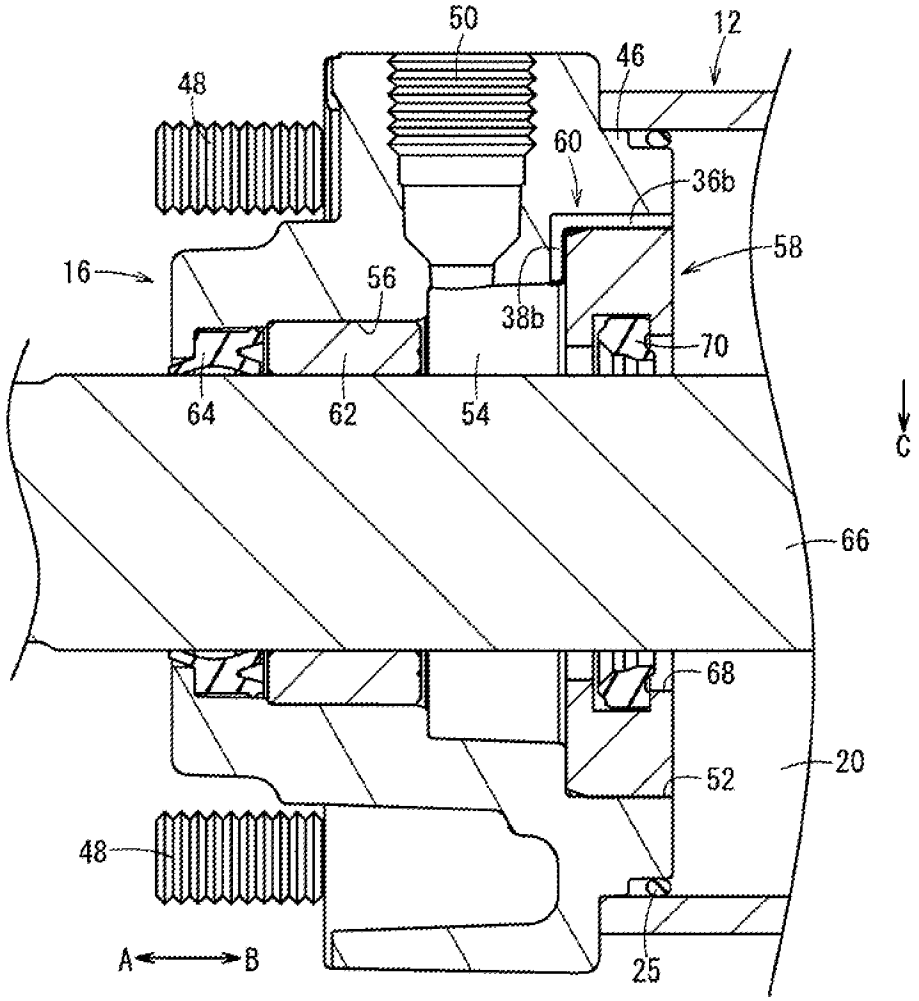
FIG. 5 is an enlarged cross-sectional view showing the vicinity of a rod cover in the fluid pressure cylinder of FIG. 1.

As shown in FIGS. 3 and 4, the first communication passage 34, for example, is formed with a rectangular shape in cross section, and in the first recess 28, is disposed at a position substantially in the same direction as the opening direction of the first port 26.

The first communication passage 34 is constituted from a horizontal portion (first flow path) 36*a*, which extends with the same cross section along the axial direction (the directions of arrows A and B) from an opening of the first recess 28, and a vertical portion (second flow path) 38*a*, which extends along a vertical direction (the direction of the arrow C) toward a central side of the first recess 28 from an end of the horizontal portion 36*a*.

More specifically, the horizontal portion 36*a* communicates with the cylinder chamber 20 by opening toward the side of the cylinder chamber 20 (in the direction of the arrow A), and a lower end of the vertical portion 38*a* communicates with the first cushion chamber 30, to be described later. Therefore, by the first communication passage 34, the cylinder chamber 20 of the cylinder tube 12 communicates with the first cushion chamber 30.

In this case, although the horizontal portion 36*a* and the vertical portion 38*a* are both formed with rectangular shapes in cross section, the cross-sectional shapes thereof are not limited, and they may be formed respectively with semicircular shapes in cross section.

Further, the first communication passage 34 is formed simultaneously at the time that the head cover 14 is manufactured by casting, and is not formed by a separate process such as a cutting process or the like after the head cover 14 has been formed by casting.

The first cushion chamber 30, for example, is formed at a smaller diameter and coaxially with respect to the first recess 28, and defines a space that is enclosed by an end of the head cover 14. In addition, the first cushion chamber 30 communicates with the first port 26 that is disposed on an outer circumferential side thereof, and together therewith, communicates with the cylinder chamber 20 through the first communication passage 34.

The first holder 32 is made up from an annular body having a first cushion hole (insertion hole) 40 in the center thereof, and by the first holder 32 being press-fitted into the first recess 28, the outer circumferential surface thereof is fitted in and fixed with respect to the inner circumferential surface of the first recess 28. Further, an end surface of the first holder 32 is fixed in a state of abutment with a wall surface of the first recess 28.

By the first holder 32 being installed in the first recess 28 in this manner, the inner circumferential side of the horizontal portion 36*a* and the cylinder tube 12 side of the vertical portion 38*a* in the first communication passage 34 are covered respectively by the outer circumferential surface and the end surface of the first holder 32, thereby forming a cross-sectionally rectangular shaped passage through which the pressure fluid flows.

Stated otherwise, in a condition with the first holder 32 not installed, the first communication passage 34 is in a state of being opened on the inner circumferential side of the head cover 14 and on the side of the cylinder tube 12, and by installation of the first holder 32, the cross-sectionally rectangular shaped passage is constituted in which the inner circumferential side and the cylinder tube 12 side are covered respectively by the first holder 32.

Further, in the first cushion hole 40, a first cushion packing (seal member) 42 is mounted in an annular groove that is formed on the inner circumferential surface thereof. The first cushion packing 42, for example, is formed in an annular shape from a resilient material such as rubber or the like, and is disposed to project out toward the inner circumferential side with respect to the inner circumferential surface of the first cushion hole 40. In addition, when a later-described first cushion rod (rod) 78 is inserted into the first cushion hole 40, the outer circumferential surface of the first cushion rod 78 slides in contact with the first cushion packing 42.

Figure 6:
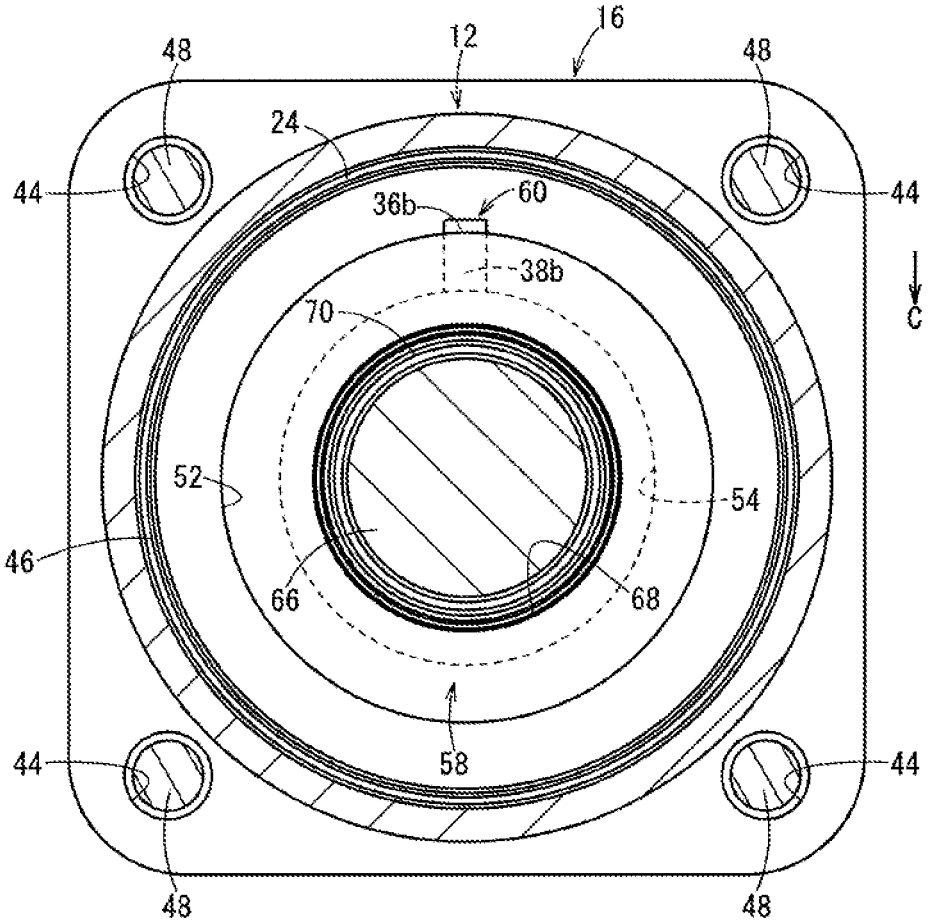
FIG. 6 is a cross-sectional view taken along line VI-VI of FIG. 1.
Figure 7:
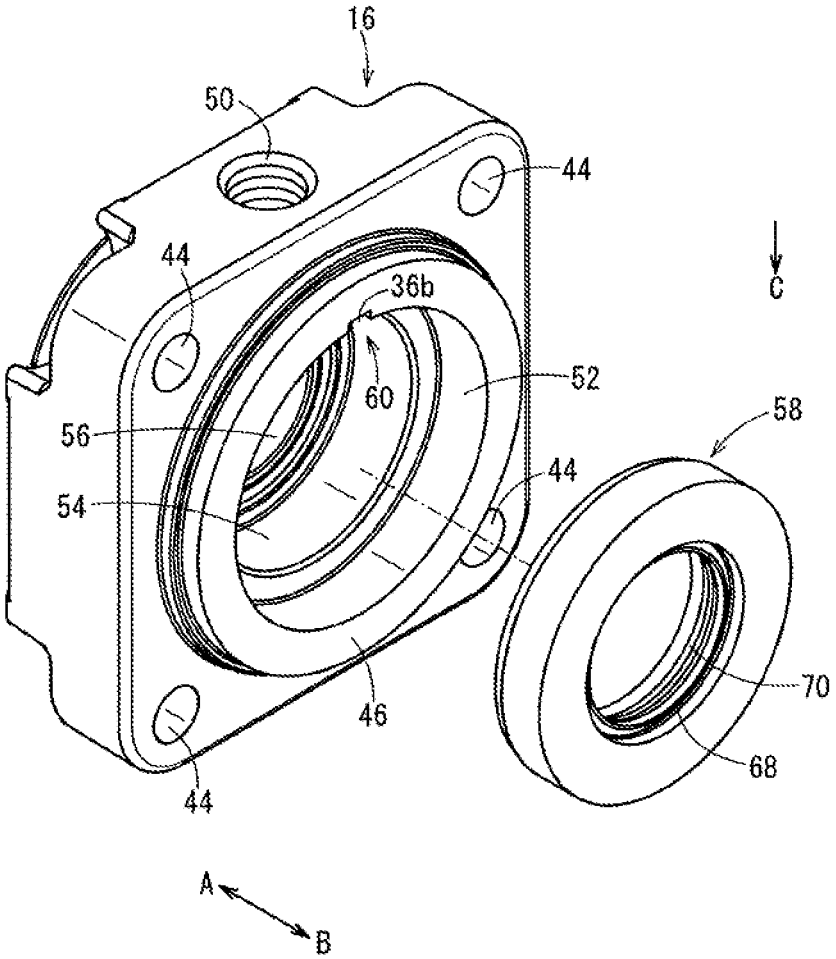
FIG. 7 is an exploded perspective view of the rod cover.

As shown in FIGS. 1 and 5 through 7, the rod cover 16, in the same manner as the head cover 14, is formed, for example, by a casting technique such as die casting or the like from a metallic material such as an aluminum alloy, and is formed with a rectangular shape in cross section having second through holes 44 that penetrate in the axial direction (the directions of arrows A and B) being formed in the four corners thereof (see FIGS. 6 and 7). Further, a second stepped portion 46, which projects at a predetermined length from an end that faces toward the side of the head cover 14 (in the direction of the arrow B), is formed on the rod cover 16, and another end of the cylinder tube 12 is retained by being inserted over an outer circumferential side of the second stepped portion 46. On the outer circumferential side of the second stepped portion 46, a gasket 25 is disposed between the second stepped portion 46 and the cylinder tube 12, whereby leakage of the pressure fluid is prevented.

In addition, in a state in which the one end of the cylinder tube 12 is inserted over the first stepped portion 24 of the head cover 14 and the other end thereof is inserted over the second stepped portion 46 of the rod cover 16, connecting rods 48 are inserted respectively through the plural first and second through holes 22, 44, and non-illustrated fastening nuts are screw-engaged and tightened on both ends thereof. Consequently, the head cover 14, the rod cover 16, and the cylinder tube 12 are fixed together integrally in a state with the cylinder tube 12 being sandwiched and gripped between the head cover 14 and the rod cover 16.

Further, on the outer side of the rod cover 16, a second port 50 is formed that extends in a perpendicular direction to the axial line of the rod cover 16, and in the second port 50, pressure fluid is supplied and discharged through non-illustrated piping.

On the other hand, in a central portion of the rod cover 16, a second recess (accommodating hole) 52 is formed with a circular shape in cross section opening in facing relation to the side of the cylinder tube 12 (in the direction of the arrow B), and together therewith, a second cushion chamber 54 is formed that communicates with the second recess 52, and a rod hole 56 is formed that communicates with the second cushion chamber 54.

A ring-shaped second holder 58 is press-fitted and fixed in the second recess 52, and a second communication passage (passage) 60, which is recessed in a radial outer direction, is formed with respect to the inner circumferential surface thereof.

As shown in FIGS. 6 and 7, the second communication passage 60, for example, is formed with a rectangular shape in cross section, and is disposed in the second recess 52 at a position substantially in the same direction as the opening direction of the second port 50. The second communication passage 60 is constituted from a horizontal portion (first flow path) 36*b*, which extends with the same cross section along the axial direction from an opening of the second recess 52, and a vertical portion (second flow path) 38*b*, which extends along a vertical direction (the direction of the arrow C) toward a central side of the second recess 52 from an end of the horizontal portion 36*b*.

More specifically, the horizontal portion 36*b* communicates with the cylinder chamber 20 by opening toward the side of the cylinder chamber 20 (in the direction of the arrow B), and a lower end of the vertical portion 38*b* communicates with the second cushion chamber 54, to be described later. Therefore, by the second communication passage 60, the cylinder chamber 20 of the cylinder tube 12 communicates with the second cushion chamber 54. Moreover, although the horizontal portion 36*b* and the vertical portion 38*b* are both formed with rectangular shapes in cross section, the cross-sectional shapes thereof are not limited, and they may be formed respectively with semicircular shapes in cross section.

Further, the second communication passage 60 is formed simultaneously at the time that the rod cover 16 is manufactured by casting, and is not formed by a separate process such as a cutting process or the like after the rod cover 16 has been formed by casting.

The second cushion chamber 54, for example, is formed at a smaller diameter and coaxially with respect to the second recess 52, and defines a space that is enclosed by an end of the rod cover 16. In addition, the second cushion chamber 54 communicates with the second port 50 that is disposed on an outer circumferential side thereof, and together therewith, communicates with the cylinder chamber 20 through the second communication passage 60.

The rod hole 56 is formed adjacent to the second cushion chamber 54 and is smaller in diameter than the second cushion chamber 54, and opens by penetrating through to the other end of the rod cover 16. A bush 62 and a rod packing 64 are disposed on the inner circumferential surface of the rod hole 56. In addition, the bush 62 serves to guide a piston rod 66, which is inserted through the rod hole 56, in the axial direction (the directions of arrows A and B), whereas the rod packing 64 prevents leakage of the pressure fluid through a site between the piston rod 66 and the rod cover 16.

The second holder 58 is made up from an annular body having a second cushion hole (insertion hole) 68 in the center thereof, and by the second holder 58 being press-fitted into the second recess 52, the outer circumferential surface thereof is fitted in and fixed with respect to the inner circumferential surface of the second recess 52. Further, an end surface of the second holder 58 is fixed in a state of abutment with a wall surface of the second recess 52, which is disposed at a boundary with the rod hole 56.

By the second holder 58 being installed in the second recess 52 in this manner, the inner circumferential side of the horizontal portion 36*b* and the cylinder tube 12 side of the vertical portion 38*b* in the second communication passage 60 are covered respectively by the outer circumferential surface and the end surface of the second holder 58, thereby forming a cross-sectionally rectangular shaped passage through which the pressure fluid flows.

Stated otherwise, in a condition with the second holder 58 not installed, the second communication passage 60 is in a state of being opened on the inner circumferential side of the rod cover 16 and on the side of the cylinder tube 12, and by installation of the second holder 58, the cross-sectionally rectangular shaped passage is constituted in which the inner circumferential side and the cylinder tube 12 side are covered respectively by the second holder 58.

Further, in the second cushion hole 68, a second cushion packing (seal member) 70 is mounted in an annular groove that is formed on the inner circumferential surface thereof. The second cushion packing 70, for example, is formed in an annular shape from a resilient material such as rubber or the like, and is disposed to project out toward the inner circumferential side with respect to the inner circumferential surface of the second cushion hole 68. In addition, when a later-described second cushion rod (rod) 80 is inserted into the second cushion hole 68, the outer circumferential surface of the second cushion rod 80 slides in contact with the second cushion packing 70.

Figure 8:
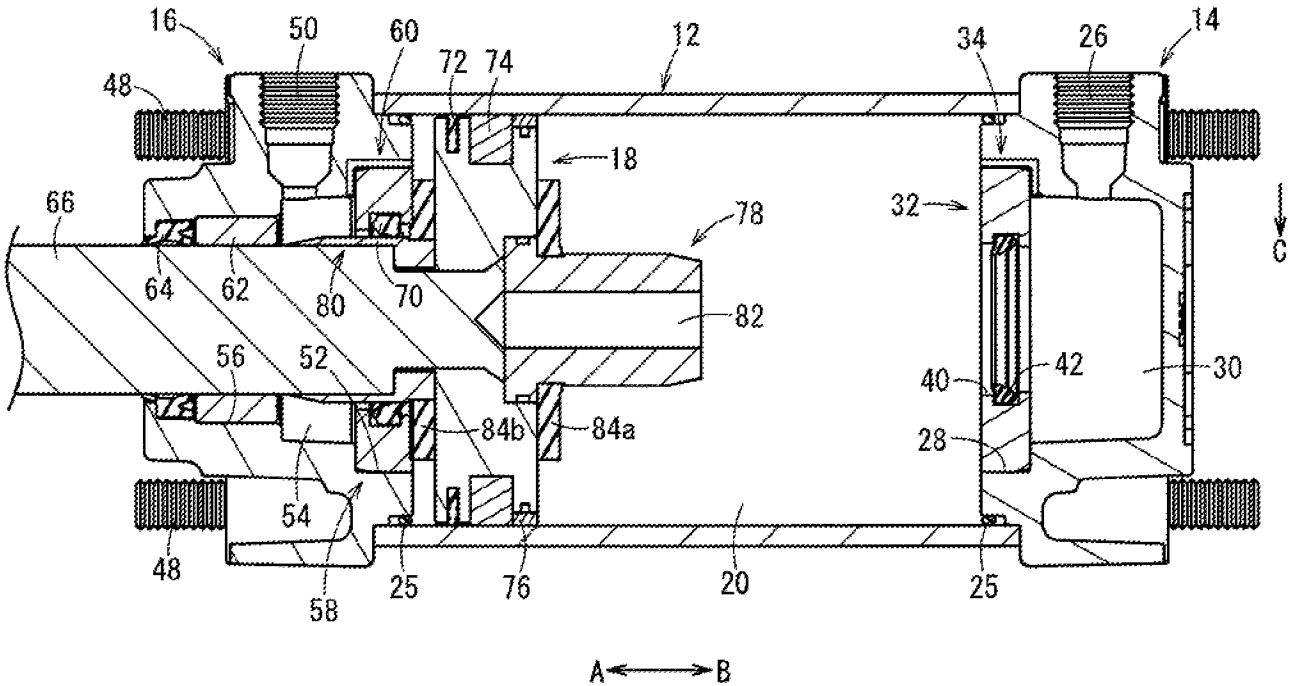
FIG. 8 is an overall cross-sectional view showing a condition in which a piston is moved to the side of the rod cover in the fluid pressure cylinder of FIG. 1.

As shown in FIGS. 1 and 8, the piston 18, for example, is formed in a disk shape, and in the center thereof, one end portion of the piston rod 66 is inserted through and caulked, thereby integrally connecting the piston rod 66 and the piston 18. Further, a piston packing 72, a magnetic body 74, and a wear ring 76 are installed through annular grooves on the outer circumferential surface of the piston 18.

Further, on one end surface side of the piston 18 facing toward the head cover 14, the first cushion rod 78 is formed coaxially therewith, which is provided so as to project at a predetermined length from the one end surface. The first cushion rod 78 is formed in a hollow shape having a hole 82 in the center thereof, and a distal end thereof is formed so as to gradually reduce in diameter in a direction (the direction of the arrow B) away from the piston 18. The first cushion rod 78 is not limited to the case of being formed in a hollow shape, and may be formed as a solid member without having the hole 82 therein.

On the other hand, on the other end surface side of the piston 18 facing toward the rod cover 16, a cylindrical second cushion rod 80 is disposed so as to cover the outer circumferential side of the piston rod 66. The second cushion rod 80 is formed to project at a predetermined length with respect to the other end surface of the piston 18, together with the distal end thereof being formed so as to gradually reduce in diameter in a direction (the direction of the arrow A) away from the piston 18.

On the outer circumferential surfaces of the first and second cushion rods 78, 80 there are provided, respectively, a pair of dampers 84*a*, 84*b* in abutment against one end surface and another end surface of the piston 18. The dampers 84*a*, 84*b*, for example, are formed from a resilient material such as rubber or urethane or the like, and are formed in disk shapes having holes in the centers thereof through which the first and second cushion rods 78, 80 can be inserted. Additionally, when the piston 18 is displaced in the axial direction (the directions of arrows A and B), the dampers 84*a*, 84*b* serve to buffer shocks by coming into abutment against end surfaces of the head cover 14 and the rod cover 16.

The piston rod 66 is constituted from a shaft having a predetermined length along the axial direction (the directions of arrows A and B), one end thereof being connected to the piston 18, and another end thereof being inserted through the rod hole 56 of the rod cover 16 and supported displaceably by the bush 62. Furthermore, a substantially central portion along the axial direction of the piston rod 66 is inserted through the second cushion hole 68 of the second holder 58.

The fluid pressure cylinder 10 according to the embodiment of the present invention is constructed basically as described above. Next, operations and advantageous effects of the fluid pressure cylinder 10 will be described. A condition in which the piston 18 shown in FIG. 1 is displaced to the side of the head cover 14 (in the direction of the arrow B), and the first cushion rod 78 is accommodated in the first cushion chamber 30 through the first holder 32 will be described as an initial position.

At first, a pressure fluid from a non-illustrated pressure fluid supply source is supplied to the inside of the first cushion chamber 30 by being introduced into the first port 26. In this case, the second port 50 is placed in a state of being open to atmosphere under a switching operation of a non-illustrated switching means. Consequently, the pressure fluid is supplied to the cylinder chamber 20 through the first communication passage 34 from the first cushion chamber 30, together with being supplied to the hole 82 of the first cushion rod 78.

Further, at the same time, by the pressure fluid flowing into the first cushion hole 40, the first cushion packing 42 is moved to the side of the rod cover 16 (in the direction of the arrow A), and the pressure fluid flows to the side of the cylinder chamber 20 via the outer circumferential side of the first cushion packing 42.

Consequently, the piston 18 is pressed toward the side of the rod cover 16 (in the direction of the arrow A). In addition, the piston rod 66 is displaced together therewith under the displacement action of the piston 18, and while the first cushion rod 78 slides on the first cushion packing 42 of the first holder 32, the first cushion rod 78 moves toward the side of the cylinder chamber 20 (in the direction of the arrow A) from the first cushion chamber 30.

At this time, the air that remains in the cylinder chamber 20 between the piston 18 and the rod cover 16 flows into the second cushion chamber 54 through the second communication passage 60, and simultaneously therewith, after having flowed into the second cushion chamber 54 through a gap between the outer circumferential surface of the piston rod 66 and the second cushion packing 70, the air is discharged to the exterior from the second port 50.

In addition, by the piston 18 moving further toward the side of the rod cover 16 (in the direction of the arrow A), the other end of the piston rod 66 progressively projects on the outer side of the rod cover 16, together with the second cushion rod 80 being inserted from the distal end thereof into the second cushion hole 68 of the second holder 58, and the second cushion rod 80 is inserted while the second cushion packing 70 slides in contact with the outer circumferential surface thereof.

Owing thereto, the gap between the second cushion packing 70 of the second holder 58 and the piston rod 66 is closed by the second cushion rod 80, and the air in the cylinder chamber 20 flows only through the second communication passage 60, and then is discharged into the second port 50. As a result, by the discharged amount of air from the second port 50 being reduced, a portion of the air becomes compressed inside the cylinder chamber 20, and displacement resistance upon displacement of the piston 18 occurs, whereby the displacement speed of the piston 18 gradually is reduced as the piston 18 approaches the displacement terminal end position. More specifically, a cushioning action functions, which is capable of decelerating the displacement speed of the piston 18.

Finally, the piston 18 is displaced gradually toward the side of the rod cover 16 (in the direction of the arrow A), and the second cushion rod 80 is accommodated completely in the second cushion hole 68 and the second cushion chamber 54. In addition, the damper 84*b* comes into abutment against the end of the rod cover 16, thus resulting in a displacement terminal end position in which the piston 18 has reached the side of the rod cover 16 (see FIG. 8).

Stated otherwise, when the second cushion hole 68 is closed by the second cushion rod 80, the second communication passage 60 functions as a fixed orifice for allowing the air of the cylinder chamber 20 to flow to the side of the second port 50.

On the other hand, in the case that the piston 18 is to be displaced in the opposite direction (in the direction of the arrow B) and restored to the initial position, under the action of a non-illustrated switching valve, the pressure fluid that was supplied to the first port 26 is supplied instead to the second port 50, whereby the pressure fluid is introduced into the second cushion chamber 54, and together therewith, the first port 26 is placed in a state of being open to atmosphere.

The pressure fluid is supplied to the cylinder chamber 20 from the second cushion chamber 54 through the second communication passage 60, and by flowing into the second cushion hole 68, the second cushion packing 70 is moved to the side of the head cover 14 (in the direction of the arrow B), and via the outer circumferential side of the second cushion packing 70, the pressure fluid flows to the side of the cylinder chamber 20. Consequently, the piston 18 is pressed toward the side of the head cover 14 (in the direction of the arrow B). In addition, the piston rod 66 is displaced together therewith under the displacement action of the piston 18, and while the second cushion rod 80 slides on the second cushion packing 70 of the second holder 58, the second cushion rod 80 moves toward the side of the cylinder chamber 20 (in the direction of the arrow B) from the second cushion chamber 54.

At this time, the air that remains in the cylinder chamber 20 between the piston 18 and the head cover 14 flows into the first cushion chamber 30 through the first communication passage 34, and simultaneously therewith, after having flowed into the first cushion chamber 30 through the opened first cushion hole 40 of the first holder 32, the air is discharged to the exterior through the first port 26.

In addition, by the piston 18 moving further toward the side of the head cover 14 (in the direction of the arrow B), the other end of the piston rod 66 becomes progressively accommodated in the rod hole 56 of the rod cover 16, together with the first cushion rod 78 being inserted from the distal end thereof into the first cushion hole 40 of the first holder 32, and the first cushion rod 78 is inserted while the first cushion packing 42 slides in contact with the outer circumferential surface thereof.

Owing thereto, the first cushion hole 40 is closed by the first cushion rod 78, and the fluid of the cylinder chamber 20 flows only through the first communication passage 34, and then is discharged into the first port 26.

By the air flow path through the first cushion hole 40 being blocked in this manner, the discharged amount of air from the first port 26 is reduced, and a portion of the air becomes compressed inside the cylinder chamber 20, and therefore, displacement resistance occurs upon displacement of the piston 18. As a result, the displacement speed of the piston 18 gradually is reduced as it approaches the initial position on the side of the head cover 14 (in the direction of the arrow B). More specifically, a cushioning action functions, which is capable of decelerating the displacement speed of the piston 18.

Finally, the piston 18 is displaced gradually toward the side of the head cover 14 (in the direction of the arrow B), and the first cushion rod 78 is accommodated completely in the first cushion hole 40 and the first cushion chamber 30. In addition, the damper 84 *a* comes into abutment against the end of the head cover 14, thus resulting in an initial position in which the piston 18 has reached the side of the head cover 14 (see FIG. 1).

Stated otherwise, when the first cushion hole 40 is closed by the first cushion rod 78, the first communication passage 34 functions as a fixed orifice for allowing the air of the cylinder chamber 20 to flow to the side of the first port 26.

In the foregoing manner, according to the present embodiment, in the fluid pressure cylinder 10 having the cushioning function, the head cover 14 and the rod cover 16 are formed by a casting technique such as die casting or the like, together with the recessed first and second communication passages 34, 60 each being formed with respect to the inner circumferential surface and the end surface of the first and second recesses 28, 52 that are formed in the interior of the head cover 14 and the rod cover 16. In addition, by the ring-shaped first and second holders 32, 58 being installed with respect to the first and second recesses 28, 52, the opened regions thereof along the direction of extension of the first and second communication passages 34, 60 are closed, and cross-sectionally rectangular shaped passages can be constituted, which are capable of providing communication between the cylinder chamber 20 and the first and second ports 26, 50, respectively.

As a result, when the head cover 14 and the rod cover 16 are manufactured by casting, the groove shaped first and second communication passages 34, 60 are formed simultaneously beforehand, whereby the first and second communication passages 34, 60 can then be formed easily, merely by assembling the first and second holders 32, 58. Therefore, compared to a case of forming the communication passages by a cutting process or the like after the head cover and the rod cover have been manufactured, the manufacturing process therefor can be shortened, together with enabling a reduction in manufacturing costs.

Further, in the head cover 14 and the rod cover 16, although the first and second communication passages 34, 60 are formed in groove-like shapes opening respectively on the inner circumferential side and on the side of the cylinder tube 12, by attachment of the ring-shaped first and second holders 32, 58 respectively in the first and second recesses 28, 52, it is possible to easily constitute the cross-sectionally rectangular shaped first and second communication passages 34, 60, which are covered respectively on the inner circumferential side and the cylinder tube 12 side thereof.

Stated otherwise, the first and second communication passages 34, 60 can easily be formed merely by assembling the first and second holders 32, 58 with respect to the head cover 14 and the rod cover 16.

The fluid pressure cylinder according to the present invention is not limited to the above embodiment. Various changes and modifications may be made to the embodiment without departing from the essential gist of the invention.

The invention claimed is:

1. A fluid pressure cylinder, comprising:

a cylinder tube including a cylinder chamber that is closed by a pair of cover members, a piston configured to be inserted into the cylinder tube and to be displaced along an axial direction in the cylinder chamber, ports formed in the cover members and through which a pressure fluid is supplied and discharged, and a rod mounted on an end portion along the axial direction of the piston and disposed displaceably together with the piston, wherein the cover members each include an accommodating hole with a ring-shaped holder inside, the rod being inserted into the ring-shaped holder, and each of the cover members further including a cushion chamber adjacent to the accommodating hole and configured to communicate with the port, wherein a groove in the accommodating hole is recessed with respect to an inner side wall of the accommodating hole and the groove of the accommodating hole is at least partially closed along a direction of extension thereof by the ring-shaped holder, thereby constituting an orifice passage providing communication between the cylinder chamber and the port, wherein the orifice passage includes a first flow path that extends along the groove of the accommodating hole in the axial direction of the piston and communicates with the cylinder chamber, wherein the orifice passage includes a second flow path that extends away from an end of the first flow path and communicates with the cushion chamber, the second flow path being between an axial end surface of the ring-shaped holder and the accommodating hole, and wherein an inner circumferential surface of the ring-shaped holder includes an annular groove and a seal member is in the annular groove.

2. The fluid pressure cylinder according to claim 1, wherein the holder is press-fitted with respect to the accommodating hole.

3. The fluid pressure cylinder according to claim 1, wherein the groove of the accommodating hole is formed with a rectangular shape in cross section or with a semicircular shape in cross section.

4. The fluid pressure cylinder according to claim 1, wherein, in the orifice passage, the first flow path and the second flow path are connected substantially perpendicularly to each other to be formed in an L-shape.

* * * * *